US008573522B2

(12) United States Patent
Lindroos et al.

(10) Patent No.: US 8,573,522 B2
(45) Date of Patent: Nov. 5, 2013

(54) REFINER AND METHOD FOR REFINING FIBROUS MATERIAL

(75) Inventors: Kati Lindroos, Lempäälä (FI); Jorma Halla, Valkeakoski (FI); Markku Partanen, Valkeakoski (FI); Kauko Vänni, Nokia (FI)

(73) Assignee: Metso Paper, Inc., Helsinki (FI)

( * ) Notice: Subject to any disclaimer, the term of this patent is extended or adjusted under 35 U.S.C. 154(b) by 283 days.

(21) Appl. No.: 12/999,666

(22) PCT Filed: Jun. 18, 2009

(86) PCT No.: PCT/FI2009/050548

§ 371 (c)(1),
(2), (4) Date: Jan. 6, 2011

(87) PCT Pub. No.: WO2009/153413

PCT Pub. Date: Dec. 23, 2009

(65) Prior Publication Data

US 2011/0198423 A1 Aug. 18, 2011

(30) Foreign Application Priority Data

Jun. 19, 2008 (FI) ..... 20080413

(51) Int. Cl.
*B02C 17/00* (2006.01)
*B02C 17/02* (2006.01)
*B02C 13/00* (2006.01)

(52) U.S. Cl.
USPC ..... 241/84; 241/86; 241/89.3

(58) Field of Classification Search
USPC ..... 241/261.2, 261.3, 297, 298, 30, 241/83–89.4, 293, 261.1
See application file for complete search history.

(56) References Cited

U.S. PATENT DOCUMENTS 2,741,954 A 4/1956 Allibe
4,221,631 A 9/1980 Hellerqvist et al.
(Continued)

FOREIGN PATENT DOCUMENTS

DE 102004039986 A1 * 12/2007 ..... D21D 1/20
JP 54050601 A 4/1979
(Continued)

OTHER PUBLICATIONS

International Search Report for PCT/FI2009/050548.
(Continued)

*Primary Examiner* — Dana Ross
*Assistant Examiner* — Chwen-Wei Su
(74) *Attorney, Agent, or Firm* — Stiennon & Stiennon

(57) ABSTRACT

A refiner (1, 18, 19) for refining fibrous material has a first refining surface (4, 11) and a second refining surface (4, 11), arranged at least partly substantially opposite to form a refiner chamber (12) to which material to be defibrated is arranged to be fed. The first or second refining surface is arranged to move in relation to the opposite refining surface. The first refining surface has elongated openings (14, 15) through which fibrous material to be refined is arranged to be fed into the refiner chamber, and/or the second refining surface has elongated openings (14, 15) through which fibrous material refined in the refiner chamber is arranged to be discharged. The elongated openings provided through the refining surface are arranged at an angle transverse to the blade bars and blade grooves of the refining surface on the first and/or second refining surface.

22 Claims, 10 Drawing Sheets

(56) References Cited

U.S. PATENT DOCUMENTS

| | | | | |
|---|---|---|---|---|
| 4,253,613 | A * | 3/1981 | Reinhall | 241/16 |
| 4,819,881 | A | 4/1989 | Sepke | |
| 5,988,538 | A | 11/1999 | Bartels | |
| 7,263,755 | B2 * | 9/2007 | Lange | 29/428 |
| 2008/0149291 | A1 * | 6/2008 | Johansson | 162/261 |

FOREIGN PATENT DOCUMENTS

| | | | |
|---|---|---|---|
| JP | 6173696 | U | 5/1986 |
| WO | 9218691 | A1 | 10/1992 |
| WO | 2009153412 | A1 | 12/2009 |
| WO | 2009153413 | A1 | 12/2009 |

OTHER PUBLICATIONS

Written Opinion of the International Searching Authority for PCT/FI2009/050548.

Supplementary European Search Report for EP09765979 dated Jun. 9, 2011.

* cited by examiner

A-A

A-A

B-B

REFINER AND METHOD FOR REFINING FIBROUS MATERIAL

CROSS REFERENCES TO RELATED APPLICATIONS

This application is a U.S. national stage application of International App. No. PCT/FI2009/050548, filed Jun. 18, 2009, the disclosure of which is incorporated by reference herein, and claims priority on Finnish App. No. 20080413, filed Jun. 19, 2008, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a refiner for refining fibrous material, the refiner comprising at least one first refining surface and at least one second refining surface, which are arranged at least partly substantially opposite to one another in such a manner that a refiner chamber, to which material to be defibrated is arranged to be fed, is formed between them, and at least either the first refining surface or the second refining surface is arranged to move with respect to the opposite refining surface, and the first refining surface and the second refining surface comprise blade bars and blade grooves between the bars.

The invention further relates to a method for refining fibrous material, the method comprising refining fibrous material with a refiner which comprises at least one first refining surface and at least one second refining surface which are arranged at least partly substantially opposite to one another in such a manner that a refiner chamber, to which material to be defibrated is fed, is formed between them, and in which at least either the first refining surface or the second refining surface is arranged to move with respect to the opposite refining surface, and in which the first refining surface and the second refining surface comprise blade bars and blade grooves between the bars.

The invention further relates to a blade segment for a refiner intended for refining fibrous material, the blade segment comprising a refining surface with blade bars and blade grooves between the bars.

Refiners for treating fibrous material typically comprise two, possibly even more, refining surfaces substantially opposite to one another, between which there is a refiner chamber to which fibrous material to be refined is fed. At least one of the refining surfaces is arranged to move relative to the opposite refining surface. The refining surface may be formed of one integral structure, or it may be formed of a plurality of refining surface segments arranged adjacent to one another, whereby the refining surfaces of individual refining surface segments form one uniform refining surface. The refining surfaces may also comprise specific blade bars, i.e., bars, and blade grooves, i.e., grooves, between the bars, whereby fibrous material is refined between the blade bars of opposite refining surfaces and both the material to be refined and the already refined material are able to move on the refining surface in the blade grooves between the blade bars. On the other hand, the refining surface may comprise protrusions and recesses between the protrusions. The blade bars and blade grooves of the refining surfaces or the protrusions and recesses of the refining surfaces may be made of the basic material of the refining surface or a different material. The protrusions may also be formed of ceramic grits attached to the refining surface by previously known methods. The refining surfaces, i.e., the blade surfaces, may also be formed of separate lamellas arranged adjacent to one another or at a distance from one another and fixed to form a refining surface. The refining surface may also comprise a very large number of small protrusions and recesses between them, in which case the refiner operates by a grinding principle.

The refiner chamber is a volume which is formed between the refining surfaces of a stator and rotor and where refining takes place. The refining is carried out by mutual pressing and motion of the refining surfaces under frictional forces between the refining surfaces and the material being refined and, on the other hand, under frictional forces created inside the material being refined. The surface area formed by the refining surfaces of the rotor and stator between them is the refining area, in which the refining between the refining surfaces of the rotor and stator takes place in the refiner chamber. The shortest distance between the refining surfaces of the rotor and stator in the region of the refining area is the blade gap.

To boost the production of refiners, it is important to be able to guide the fibrous material to be refined efficiently between the opposite refining surfaces for refining. At the same time, it is naturally important to be able to remove the already sufficiently refined material from between the refining surfaces in such a manner that the already refined material does not block up the refiner chamber between the refining surfaces and thus weaken the production of the refiner. Particularly in refining surfaces comprising blade bars and blade grooves between the bars, the guiding of fibrous material between the opposite blade bars has been made more efficient by providing at the bottom of the grooves special dams that force the material being refined to move away from the bottom of the grooves and on between the opposite refining surfaces. However, the effect of the dams is local and thus does not substantially benefit the whole area of the refining surface. The dams also considerably diminish the hydraulic capacity of the refining surface.

By changing the height of the blade groove bottom and/or the volume of the blade groove, it is also possible to try to force the flow of the material being refined to move between the opposite refining surfaces and thus make the refining more efficient. In addition, by tilting the blade bars, it is also possible to try to affect the flow of material being refined and thus force the material being refined to pass between the opposite blade bars.

A problem with all these solutions is, however, that they do not significantly improve the guiding of the material being refined into the refiner chamber without simultaneously weakening the production capacity of the refiner.

SUMMARY OF THE INVENTION

It is an object of the present invention to provide a new type of refiner and a method, in which the flow of the material being refined is guided more efficiently into the refiner chamber and blade gap between the opposite refining surfaces, thus, also making the operation of the refiner more efficient.

The refiner of the invention is characterized in that a first refining surface has elongated openings provided through it and through the openings the fibrous material being refined is arranged to be fed into the refiner chamber of the refiner, and/or a second refining surface has elongated openings provided through it and through the openings the fibrous material refined in the refiner chamber is arranged to be removed from the refiner chamber, and that the openings provided through the refining surface are arranged to be at an angle transverse to the blade bars and blade grooves of the refining surface on the first and/or second refining surface.

The method of the invention is characterized by feeding fibrous material to be refined through the elongated openings provided through the first refining surface into the refiner chamber between the refining surfaces of the refiner, and/or removing refined fibrous material from the refiner chamber through the elongated openings provided through the second refining surface, and the elongated openings provided through the first and/or second refining surface are arranged to be at an angle transverse to the blade bars and blade grooves of the refining surface.

A blade segment of the invention is characterized in that the refining surface of the blade segment has elongated openings provided through the refining surface and arranged at an angle transverse to the blade bars and blade grooves of the refining surface.

The refiner for refining fibrous material comprises at least one first refining surface and at least one second refining surface which are arranged at least partly substantially opposite to one another in such a manner that a refiner chamber, to which material to be defibrated is arranged to be fed, is formed between them, and that at least either the first refining surface or the second refining surface is arranged to move with respect to the opposite refining surface. The first refining surface and the second refining surface comprise blade bars and blade grooves between the bars. Further, the first refining surface of the refiner has elongated openings provided through it and through the openings fibrous material to be refined is arranged to be fed into the refiner chamber, and/or the second refining surface has elongated openings provided through it and through the openings fibrous material refined in the refiner chamber is arranged to be removed from the refiner chamber. Further, the elongated openings provided through the refining surfaces are arranged at an angle transverse to the blade bars and blade grooves of the refining surface on the first and/or second refining surface.

Thus, the refiner chamber is a volume which is formed between the refining surfaces of a stator and rotor and where refining takes place. The surface area formed by the refining surfaces of the rotor and stator between them is the refining area, in which the refining between the refining surfaces of the rotor and stator takes place in the refiner chamber.

In the context of this specification and the claims, the term "blade bar" also refers to the previously mentioned protrusions, and the term "blade groove" also refers to the recesses between said protrusions.

By feeding the fibrous material to be refined through the first refining surface into the refiner chamber and/or by removing the already refined fibrous material from the refiner chamber through the second refining surface substantially opposite to the first refining surface, it is possible to feed fibrous material into the refiner chamber more efficiently and evenly than before so that the distribution of the material being refined is more even, which in turn improves the efficiency of refining and thus also the capacity of the refiner. Simultaneously, the efficiency of the refiner may further be improved from that of the previously known solutions by making the openings provided through the refining surfaces elongated and arranging said openings at an angle transverse to the blade bars and blade grooves of the refining surface.

According to an embodiment of the invention, the first refining surface is arranged to form a moving refining surface of the refiner, and the second refining surface is arranged to form a fixed refining surface of the refiner.

According to an embodiment of the invention, the first refining surface is arranged to form a fixed refining surface of the refiner, and the second refining surface is arranged to form a moving refining surface of the refiner.

When the moving refining surface is arranged to be the inner refining surface, which is possible with a cylindrical and conical refiner, it provides through centrifugal force in the material flow a pumping effect that improves the transfer of the material to be refined into the refiner chamber. The pumping effect may further be increased or decreased by directing the opening or structure before the opening or by flow-related design, because the walls of the opening in the moving refining surface that push the material flow cause a force resultant in the material flow in the direction of the normal of the wall. When the moving refining surface is arranged as the outer refining surface, it is possible to affect the flow through the opening in a corresponding manner by directing the opening. In the case of a disc refiner, the flow through the opening in the moving refining surface may also be improved by means of the centrifugal force by directing the opening at least to some extent in the direction of the radius. A fixed refining surface does not produce a flow by means of the centrifugal force, but the flow through the fixed refining surface can be reduced somewhat or a great deal by directing the opening by means of forces transmitted to the material flow via the walls of the opening.

According to a third embodiment of the invention, the surface area of the refining area of the refiner chamber is at least 70% of the surface area of the moving refining surface, which further increases the efficiency of the refiner.

According to a fourth embodiment of the invention, the ratio of the surface area of said openings provided through the refining surface to the total area of the refining surface ranges preferably from 5 to 70%, more preferably from 7 to 55%, and most preferably from 10 to 40%.

According to a fifth embodiment of the invention, the elongated openings are arranged at an angle of 5 to 90 degrees, preferably 25 to 80 degrees and more preferably 50 to 70 degrees to the blade bars and blade grooves of the refining surface.

BRIEF DESCRIPTION OF THE DRAWINGS

Some embodiments of the invention will be described in more detail in the attached drawings.

In the figures, some embodiments of the invention are shown simplified for the sake of clarity. Similar parts are marked with the same reference numbers in the figures.

DESCRIPTION OF THE PREFERRED EMBODIMENTS

Figure 1:
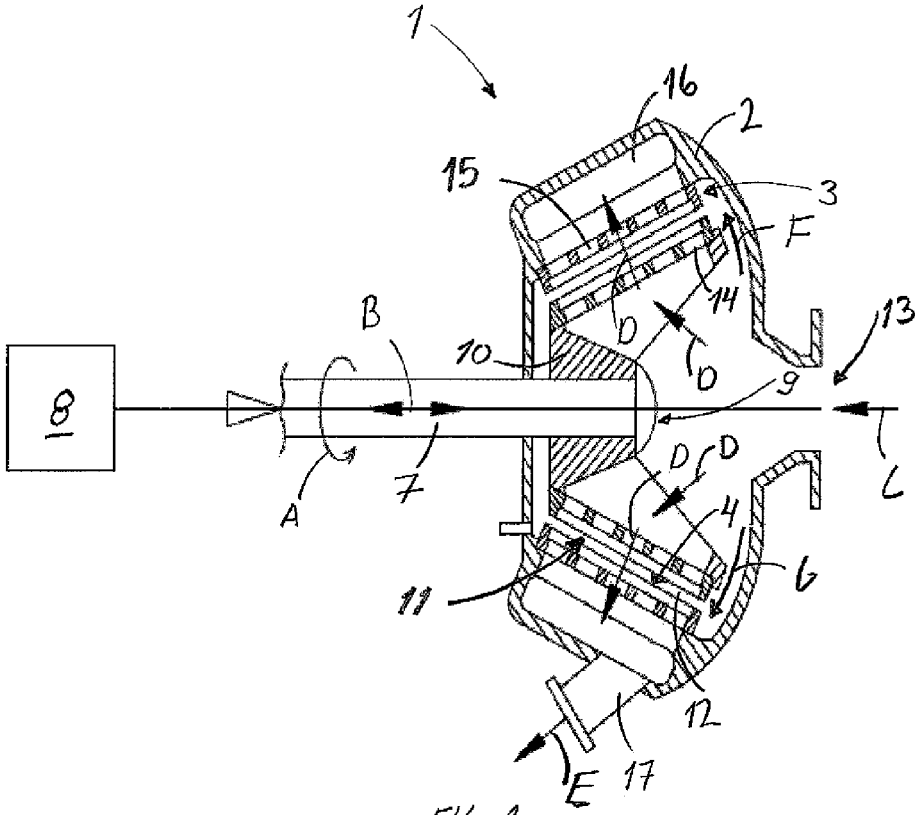
FIG. 1 schematically shows a side view of a cone refiner in cross-section.
Figure 2:
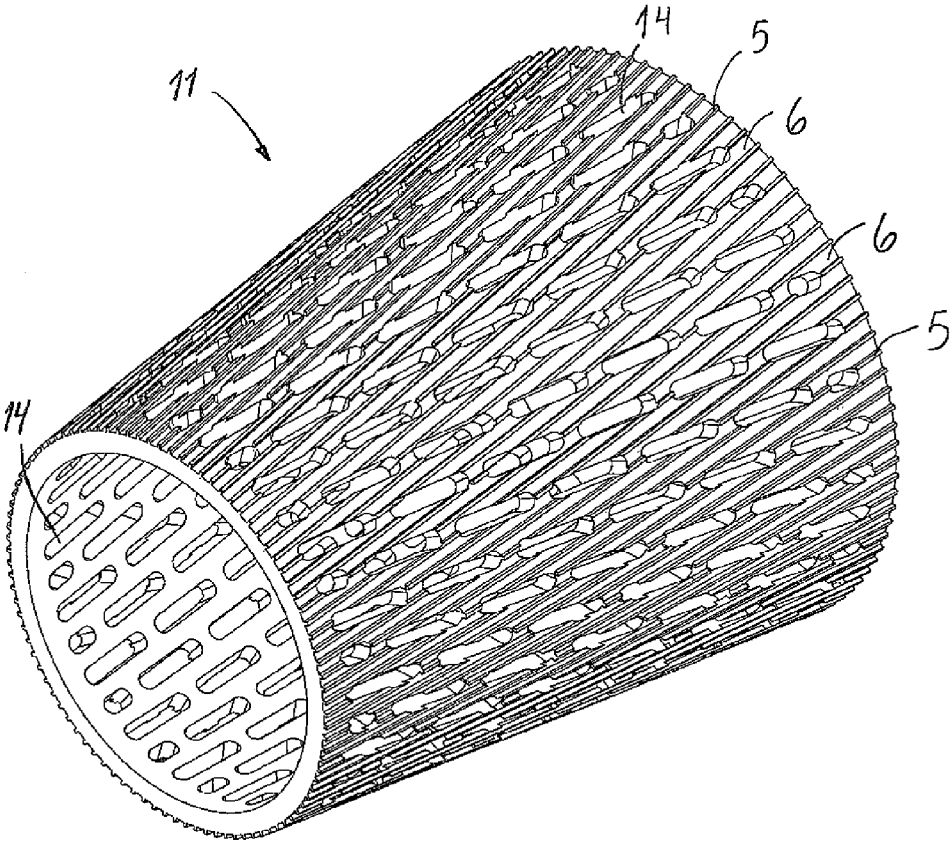
FIG. 2 schematically shows a conical refining surface axonometrically.

FIG. 1 schematically shows in cross-section a side view of a conical refiner 1, which is used for refining fibrous material, such as material used for manufacturing paper or paperboard. FIG. 2, in turn, shows schematically and axonometrically a conical refining surface which may be used as a refining surface of the rotor, for example, but also as a refining surface of the stator, in the refiner according to FIG. 1. When there are blade bars and blade grooves between the bars in the refining surface, they are naturally positioned on the refining surface, i.e., blade surface, that performs the refining treatment of fibrous material. The refiner 1 shown in FIG. 1 comprises a frame 2 of the refiner 1 and a stationary, fixed refiner element 3, i.e. stator 3, supported to the frame 2 and provided with a refining surface 4 of the stator 3. The refining surface 4 has blade bars 5 and blade grooves 6 between the bars, as shown in more detail in FIG. 2. The refiner 1 further has a refiner element 9 arranged to be rotated by a shaft 7 and a highly schematically depicted motor 8, by way of example, in the direction of arrow A, for instance, and due to its rotating movement, the refiner element may also be called a rotor 9 of the refiner 1. The rotor 9 of the refiner 1 comprises a body 10 and a refining surface 11 of the rotor 9 composed of blade bars 5 and blade grooves 6. In the embodiment of FIG. 1, the majority of the body 10 of the rotor 9 has a hollow structure so that there is a plenty of open space inside the rotor 9 body 10. The refiner 1 may also comprise a loader not shown in FIG. 1 for the sake of clarity, which can be used for moving the rotor attached to the shaft 7 back and forth, as shown schematically by arrow B, in order to adjust the size of the refiner chamber 12 and the blade gap between the refining surface 4 of the stator 3 and the refining surface 11 of the rotor 9.

The fibrous material to be refined is fed into the refiner 1 via a feed opening 13 or feed channel in a manner shown by arrow C. The majority of the fibrous material fed into the refiner 1 passes in the manner shown by arrows D through the openings 14 formed through the refining surface 11 of the rotor 9 to the refining chamber 12 between the refining surface 11 of the rotor 9 and the refining surface 4 of the stator 3, in which the fibrous material is refined. The already refined material is, in turn, able to pass through the openings 15 in the refining surface 4 of the stator 3 into the intermediate space 16 between the refiner 1 frame 2 and the stator 3, from where the refined material is removed via a discharge channel 17 or discharge opening out of the refiner 1, as shown schematically by arrow E. Since the space between the rotor 9 and the frame 2 of the refiner 1 is not fully closed, part of the fibrous material being fed into the refiner 1 may transfer into the refiner chamber 12 as shown by arrows F from the right end of the refiner chamber 12 as seen in FIG. 1. The already refined material may also exit the refiner chamber 12 from the left end of the refiner chamber 12 as seen in FIG. 1, from where there is a connection to the intermediate space 16 between the refiner 1 frame 2 and the stator 3.

In the embodiment of FIG. 1, the refining surface 11 of the moving refiner element 9, i.e., the rotor 9, constitutes the first refining surface of the refiner, and the openings 14 formed through the refining surface 11 of the rotor 9 constitute first openings formed through the first refining surface, through which material to be refined is fed into the refiner chamber between the refining surfaces of the refiner. Further, in the embodiment of FIG. 1, the refining surface 4 of the fixed refiner element 3, i.e., the stator 3, constitutes the second refining surface of the refiner, and the openings 15 formed through the refining surface 4 of the stator 3 constitute second openings formed through the second refining surface, through which fibrous material refined in the refiner chamber 12 is removed from the refiner chamber. In addition, in the embodiment of FIG. 1, in which both the refining surface 4 of the stator 3 and the refining surface 11 of the rotor 9 extend essentially around the entire conical circumference, the surface area of the refining area between the refining surfaces 4 and 11 is at least 70% of the surface area of the movably-arranged refining surface, i.e., the rotor 9, which makes the refining more efficient. However, the refining surfaces 4 and 11, and especially the refining surface 4 of the stator 3, need not extend around the entire conical circumference, but a more efficient refining may also be achieved when the surface area between the refining surface 4 of the stator 3 and the refining surface 11 of the rotor 9 is at least 70%, preferably at least 85%, and most preferably 100% of the surface area of the refining surface 11 of the rotor 9. The surface area of the refining area between the refining surfaces may also be smaller than 70% of the surface area of the movably-arranged refining surface.

The openings 15 formed through the refining surface 4 of the stator 3 and the openings 14 formed through the refining surface 11 of the rotor 9 may be formed through the blade bars 5 on the refining surface only, through the blade grooves 6 on the refining surface only, or through both the blade bars 5 and the blade grooves 6 on the refining surface. In the embodiment of FIG. 1, due to the openings 14 on the refining surface 11 of the rotor 9, the fibrous material to be refined can be efficiently fed into the refiner chamber 12 between the refining surfaces, whereby the fibrous material can be refined more efficiently than before. In addition, due to the openings 14 on the refining surface 11 of the rotor 9, the fibrous material to be refined can also be fed into the refiner chamber 12 more evenly than before so that the distribution of the material to be refined in the refiner chamber 12 is more even than before, which in turn also increases the efficiency of the refining and thus the capacity of the refiner. Because of the openings 15 on the refining surface 4 of the stator 3 of the refiner 1, the already refined pulp can be transferred away from the refiner chamber 12 more efficiently than before, thus reducing the risk of blocking up the refining surface 4 and also improving the operation of the refiner.

The refining surface of the rotor or stator is provided with openings, when the distance from the edge of an opening to the edge of the closest, second opening, i.e., the measurement of the space without openings, is less than 200 mm. More preferably, the distance from the edge of an opening to the edge of another opening is less than 100 mm. Most preferably the distance from the edge of an opening to the edge of another opening is less than 50 mm.

Because there are openings on both refining surfaces defining the refiner chamber, a good yield is primarily affected by the total area of the openings. It is possible to improve the refining result, when the openings are located at a sufficient distance from each other, which means that the material to be refined stays longer in the refiner chamber before it is discharged and undergoes a refining treatment resulting in a good pulp quality. On the other hand, when openings are densely located, the material to be refined is efficiently guided directly to each blade bar for refining, and the refiner blades are utilized efficiently for refining treatment. When a refiner with densely located openings is used with a high through-flow, the production is high and refining is efficient. By reducing the through-flow, or production, the refining time can be made longer, and also a blade with densely located openings provides a sufficient residence time in the refiner chamber and a good pulp quality.

Figure 3:
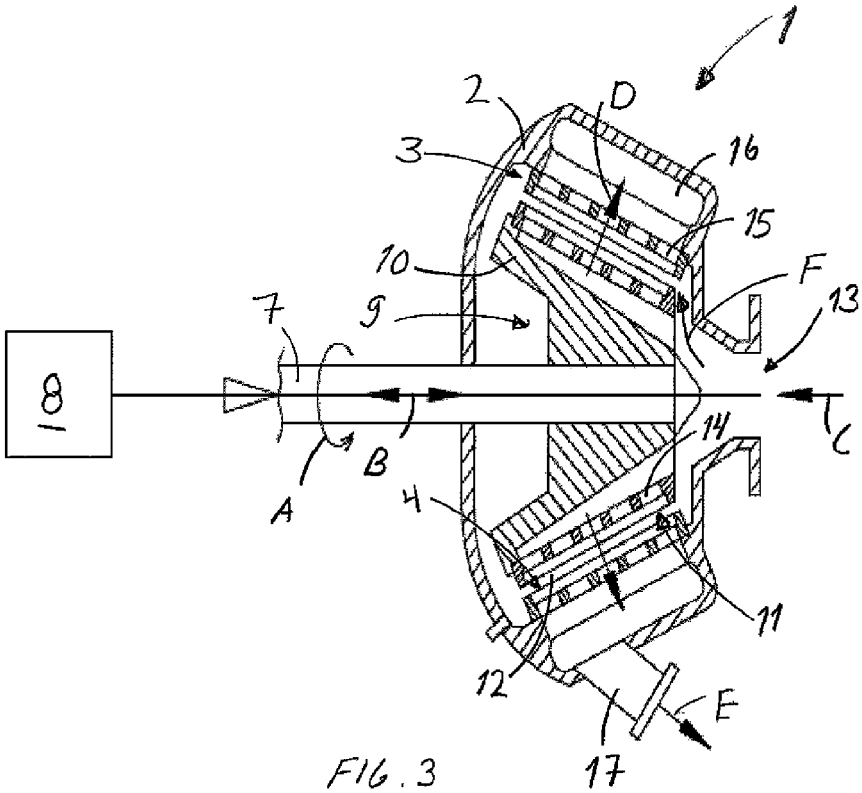
FIG. 3 schematically shows a side view of a second cone refiner in cross-section.

FIG. 3 schematically shows in cross-section a side view of another cone refiner 1 for refining fibrous material. The cone refiner 1 shown in FIG. 3 differs from the cone refiner shown in FIG. 1 in that the inclination direction of the cone structure of the refiner shown in FIG. 3 is opposite to that of the cone structure of the refiner shown in FIG. 1; in other words, in the refiner of FIG. 3, the greater diameter of the cone is directed away from the feed direction of the material to be refined, whereas in the refiner shown in FIG. 1, the greater diameter of the refiner is directed towards the feed direction of the material to be refined. In addition, the body 10 of the rotor 9 of the refiner shown in FIG. 3 is more massive or closed in structure than the body 10 of the rotor 9 of the refiner shown in FIG. 1, as a result of which the open space below the refining surface 11 of the rotor 9 is smaller in the refiner of FIG. 3 than in that of FIG. 1. Otherwise, the operation of the refiner shown in FIG. 3 corresponds to the operation of the refiner shown in FIG. 1.

Figure 4:
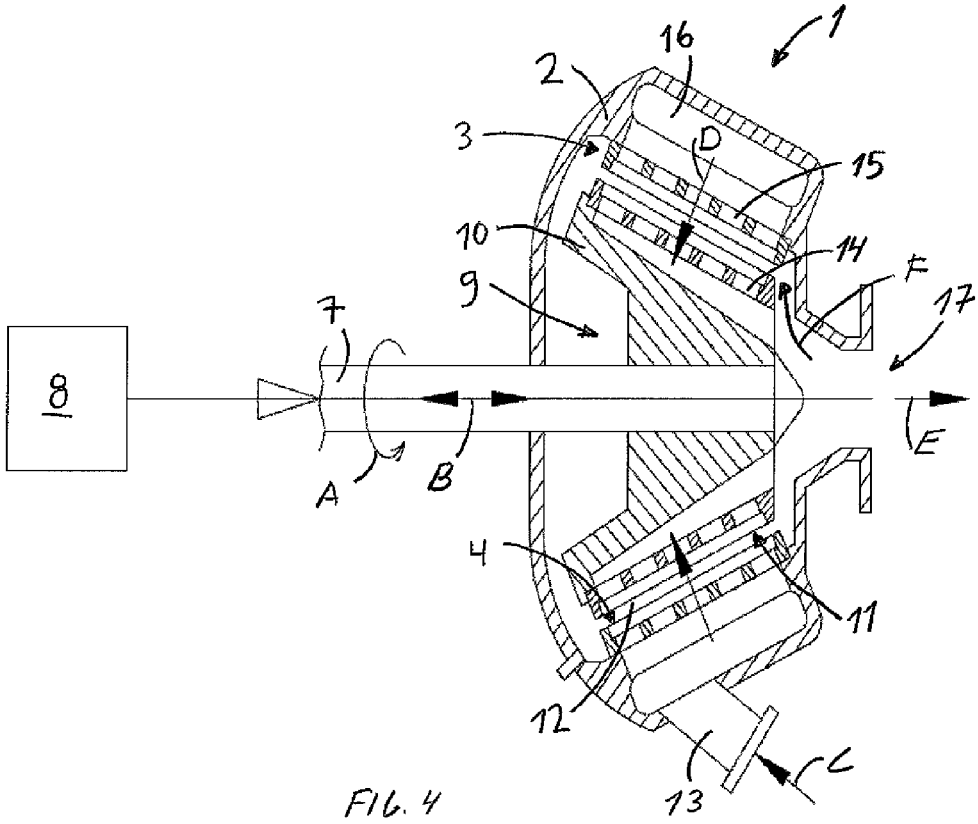
FIG. 4 schematically shows a side view of a third cone refiner in cross-section.

FIG. 4 schematically shows in cross-section a side view of a third cone refiner 1 for refining fibrous material. The basic structure of the cone refiner shown in FIG. 3 corresponds to that of the refiner of FIG. 3, but the refiner of FIG. 4 operates in an opposite manner compared to the refiner of FIG. 3. This means that in the refiner shown in FIG. 4, the feed channel 13 or feed opening for feeding fibrous material into the refiner is arranged on the outer circumference of the refiner 1, and the discharge opening 17 or discharge channel for removing refined material from the refiner is arranged in the center section of the refiner 1 in a location where the refiner of FIG. 3 comprises a feed opening 13 or feed channel for feeding material to be refined into the refiner. In the refiner of FIG. 4, the fibrous material to be refined is thus first fed via the feed channel 13 or feed opening of the refiner 1 into the intermediate space 16 between the frame 2 and the stator 3 of the refiner 1, from where the material to be refined passes on into the refiner chamber 12 through the openings 15 on the refining surface 4 of the refiner's stator 3. The majority of the refined material is removed from the refiner chamber 12 through the openings 14 on the refining surface 11 of the rotor 9, and a small amount is possibly removed as a leakage flow from the end of the refiner chamber 12 on the right-hand side in FIG. 4 between the rotor 9 and the refiner 1 frame 2.

In the embodiment of FIG. 4, the refining surface 11 of the moving refiner element 9, i.e., the rotor 9, constitutes the second refining surface of the refiner, and the openings 14 formed through the refining surface 11 of the rotor 9 constitute the second openings formed through the second refining surface, through which fibrous material refined in the refiner chamber 12 is removed from the refiner chamber. Further, in the embodiment of FIG. 4, the refining surface 4 of the fixed refiner element 3, i.e., the stator 3, constitutes the first refining surface of the refiner, and the openings 15 formed through the refining surface 4 of the stator 3 constitute the first openings formed through the first refining surface, through which material to be refined is fed into the refiner chamber between the refiner's refining surfaces. In addition, in the embodiment of FIG. 4, in which both the refining surface 4 of the stator 3 and the refining surface 11 of the rotor 9 extend essentially around the entire conical circumference, the surface area of the refining area between the refining surfaces 4 and 11 is more than 70% of the surface area of the movably-arranged refining surface, i.e., the rotor 9.

Figure 5:
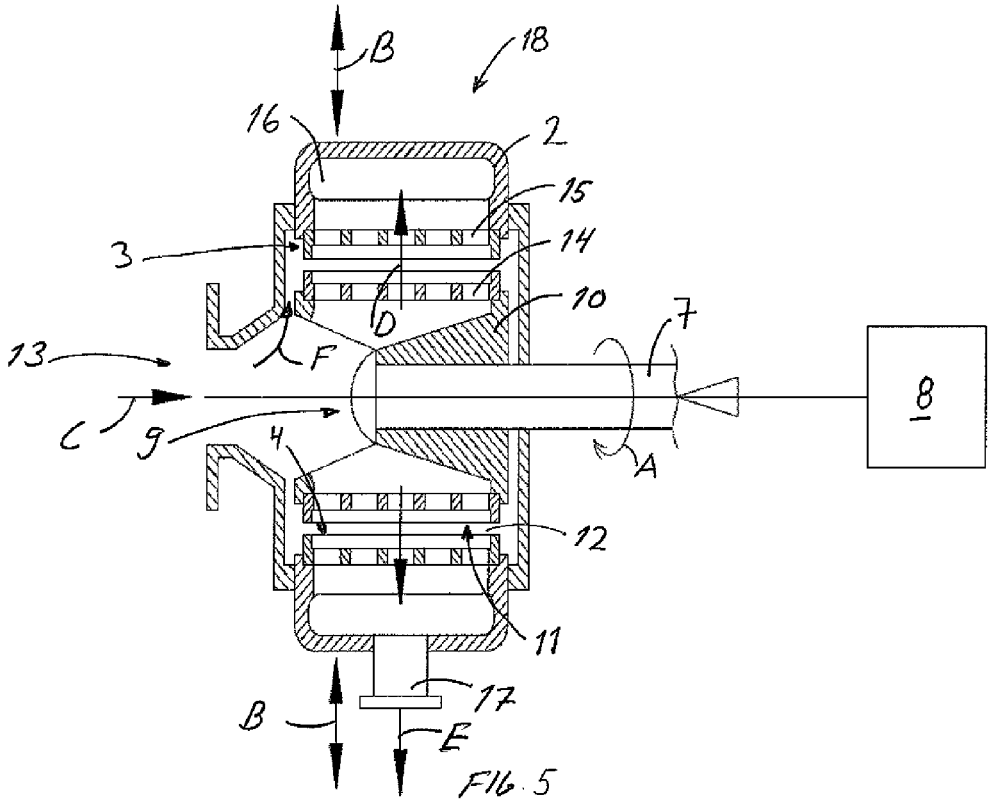
FIG. 5 schematically shows a side view of a cylindrical refiner in cross-section.

FIG. 5 schematically shows in cross-section a side view of a cylindrical refiner 18, which is used for refining fibrous material, such as material used for manufacturing paper or paperboard. The refiner 18 shown in FIG. 5 comprises a frame 2 and a stationary, fixed refiner element 3, i.e. stator 3, supported to the frame 2 of the refiner 18 and provided with a refining surface 4 of the stator 3. The refining surface further has blade bars and blade grooves between the bars. The refiner 18 further has a refiner element 9 arranged to be rotated by a shaft 7 and a highly schematically depicted motor 8, by way of example, in the direction of arrow A, for instance, and due to the rotating movement, the refiner element may also be called a rotor 9 of the refiner 18. The rotor 9 of the refiner 18 comprises a body 10 and a refining surface 11 composed of blade bars 5 and blade grooves 6. In the embodiment of FIG. 5, the majority of the body 10 of the rotor 9 has a hollow structure so that there is plenty of open space inside the rotor 9 body 10. The refiner 18 may also comprise an adjustment structure for adjusting the size of the refiner chamber 12 between the refining surface 4 of the stator 3 and the refining surface 11 of the rotor 9 in the direction schematically shown by arrows B. The adjustment may be carried out by previously known manners, in which the distance between at least one refining surface and another refining surface is adjusted. The adjustment is performed by a screw or wedge mechanism or a hydraulic loading mechanism, for instance.

The fibrous material to be refined is fed into the refiner 18 via a feed opening 13 or feed channel in a manner shown schematically by arrow C. The majority of the fibrous material fed into the refiner 18 passes in the manner shown by arrows D through the openings 14 formed through the refining surface 11 of the rotor 9 to the refiner chamber 12, in which the fibrous material is refined. The already refined material is, in turn, able to pass through the openings 15 in the refining surface 4 of the stator 3 into the intermediate space 16 between the refiner 18 frame 2 and the stator 3, from where the refined material is removed via the discharge channel 17 or discharge opening out of the refiner 18, as shown schematically by arrow E.

Since the space between the rotor 9 and the frame 2 of the refiner 18 is not fully closed, part of the fibrous material fed into the refiner 18 may transfer into the refiner chamber 12 as shown by arrows F from the left end of the refiner chamber as seen in FIG. 5. The already refined material may also exit the refiner chamber 12 from the right end of the refiner chamber 12 as seen in FIG. 5, from where there is a connection to the intermediate space 16 between the refiner 18 frame 2 and the stator 3.

In the embodiment of FIG. 5, the refining surface 11 of the moving refiner element 9, i.e., the rotor 9, constitutes the first refining surface of the refiner, and the openings 14 formed through the refining surface 11 of the rotor 9 constitute first openings formed through the first refining surface, through which material to be refined is fed into the refiner chamber between the refining surfaces of the refiner. Further, in the embodiment of FIG. 5, the refining surface 4 of the fixed refiner element 3, i.e., the stator 3, constitutes the second refining surface of the refiner, and the openings 15 formed through the refining surface 4 of the stator 3 constitute second openings formed through the second refining surface, through which fibrous material refined in the refiner chamber 12 is removed from the refiner chamber. In addition, in the embodiment of FIG. 5, in which both the refining surface 4 of the stator 3 and the refining surface 11 of the rotor 9 extend essentially around the entire cylindrical circumference, the surface area of the refining area of the refiner chamber 12 between the refining surfaces 4 and 11 is more than 70% of the surface area of the refining surface of the movably-arranged refining surface, i.e., the rotor 9, which makes the refining more efficient.

In a manner corresponding to what is stated above in connection with conical refiners, in a cylindrical refiner the feeding of fibrous material to the cylindrical refiner 18 may also be arranged such that the fibrous material to be refined moves through the openings 15 in the refining surface 4 of the stator 3 to the refiner chamber 12 and the already refined material is discharged from the refiner chamber 12 through the openings 14 in the refining surface 11 of the rotor 9. In this case, the feed channel or feed opening for feeding fibrous material to be refined into the refiner and the discharge channel or discharge opening for removing the refined material from the refiner change places with one another. The refining surface 11 of the moving refiner element 9, i.e., the rotor 9, would then constitute the second refining surface of the refiner, and the openings 14 formed through the refining surface 11 of the rotor 9 would constitute the second openings formed through the second refining surface, through which the already refined fibrous material would be removed from the refiner chamber 12. Correspondingly, the refining surface 4 of the fixed refiner element 3, i.e. the stator 3, would constitute the first refining surface of the refiner, and the openings 15 formed through the refining surface 4 of the stator 3 would constitute the first openings formed through the first refining surface, through which fibrous material to be refined would be fed into the refiner chamber 12.

Figure 6:
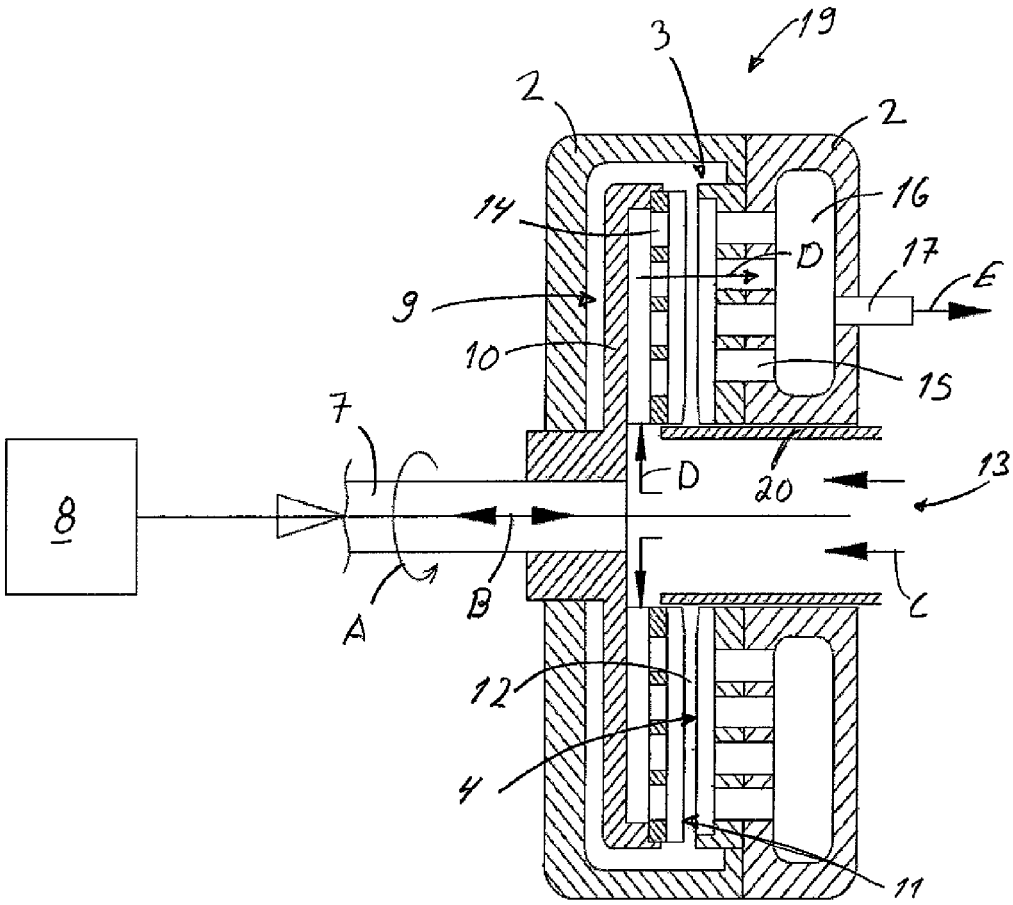
FIG. 6 schematically shows a side view of a disc refiner in cross-section.

FIG. 6 schematically shows in cross-section a side view of a disc refiner 19, which is used for refining fibrous material, such as material used for manufacturing paper or paperboard. The refiner 19 shown in FIG. 6 comprises a frame 2 of the refiner 19 and a stationary, fixed refiner element 3, i.e., stator 3, supported to the frame 2 and provided with a refining surface 4 of the stator 3. The refining surface 4 has blade bars and blade grooves between the bars. The refiner 19 further has a refiner element 9 arranged to be rotated by a shaft 7 and a highly schematically depicted motor 8, by way of example, in the direction of arrow A, for instance, and due to the rotating movement, the refiner element may also be called a rotor 9 of the refiner 19. The rotor 9 comprises a body 10 and a rotor 9 refining surface 11 composed of blade bars and blade grooves. In the embodiment of FIG. 6, part of the body 10 of the rotor 9 has a hollow structure so that there is plenty of open space behind the refining surface 11 of the rotor 9. The refiner 19 may also comprise a loader not shown in FIG. 6 for the sake of clarity, which can be used for moving the rotor attached to the shaft 7 back and forth, as shown schematically by arrow B, in order to adjust the size of the refiner chamber 12 between the refining surface 4 of the stator 3 and the refining surface 11 of the rotor 9.

The fibrous material to be refined is fed into the refiner 19 via a feed opening 13 or feed channel 13 in a manner shown schematically by arrow C. The majority of the fibrous material fed into the refiner 19 passes in the manner shown by arrows D through the openings 14 formed through the refining surface 11 of the rotor 9 to the refiner chamber 12, in which the fibrous material is refined. The already refined material is in turn able to pass through the openings 15 in the refining surface 4 of the stator 3 into the intermediate space 16 between the refiner 19 frame 2 and the stator 3, from where the refined material is removed via a discharge channel 17 or discharge opening out of the refiner 19, as shown schematically by arrow E. The already refined material may also exit the refiner chamber 12 from the outer circumference of the refining surfaces 4, 11, from where there is also a connection to the intermediate space 16 between the refiner 19 frame 2 and the stator 3. Transfer of material to be refined and fed into the refiner from the feed opening 13 directly to the refiner chamber 12 is prevented by a protective structure 20.

In the embodiment of FIG. 6, the refining surface 11 of the moving refiner element 9, i.e., the rotor 9, constitutes the first refining surface of the refiner, and the openings 14 formed through the refining surface 11 of the rotor 9 constitute first openings formed through the first refining surface, through which material to be refined is fed into the refiner chamber between the refining surfaces of the refiner. Further, in the embodiment of FIG. 6, the refining surface 4 of the fixed refiner element 3, i.e., the stator 3, constitutes the second refining surface of the refiner, and the openings 15 formed through the refining surface 4 of the stator 3 constitute second openings formed through the second refining surface, through which fibrous material refined in the refiner chamber 12 is removed from the refiner chamber. In addition, in the embodiment of FIG. 5, in which both the refining surface 4 of the stator 3 and the refining surface 11 of the rotor 9 extend essentially around the entire disc-shaped circumference, the surface area of the refining area of the refiner chamber 12 between the refining surfaces 4 and 11 is more than 70% of the surface area of the refining surface of the movably-arranged refining surface, i.e., the rotor 9, which makes the refining more efficient.

As was described above in connection with cone refiners and cylindrical refiners, in disc refiners, too, the feeding of fibrous material into the disc refiner 19 may be arranged in such a manner that fibrous material to be refined is fed into the intermediate space 16, from where it passes through the openings 15 on the refining surface 4 of the stator 3 into the refiner chamber 12. The already refined material may in turn be removed from the refiner chamber 12 through the openings 14 on the refining surface 11 of the rotor 9. In this case, the feed opening 13 or feed channel 13 for feeding fibrous material to be refined into the refiner 19 and the discharge channel 17 or discharge opening for removing the already refined fibrous material from the refiner 19 change places with one another. The refining surface 11 of the moving refiner element 9, i.e., the rotor 9, would then constitute the second refining surface of the refiner, and the openings 14 formed through the refining surface 11 of the rotor 9 would constitute the second openings formed through the second refining surface, through which the already refined material would be removed from the refiner chamber between the refining surfaces. Correspondingly, the refining surface 4 of the fixed refiner element 3, i.e., the stator 3, would then constitute the first refining surface of the refiner, and the openings 15 formed through the refining surface 4 of the stator 3 would constitute the first openings formed through the first refining surface, through which fibrous material to be refined would be fed into the refiner chamber 12.

By feeding fibrous material to be refined through the refining surface and by removing the already refined material through the opposite refining surface, it is possible to avoid or diminish the flow of the material to be refined and of the already refined material in the direction of the refining surface, which reduces pressure losses in the refiner. It is also ensured that the material to be refined flows from the feed of material to its discharge via the refiner chamber, which means that a greater number of fibers will be refined than before. By means of the feed rate of the material to be refined and the speed of the moving refining surface, it is possible to influence the degree of refining, i.e. how much refining the fibers are subjected to.

Because, owing to the solution, the material flow is directed more efficiently than before to the refiner chamber, the fibers being processed are processed in a more homogenous manner than before. In addition, in refining surfaces comprising blade bars and blade grooves, the refining surface may be utilized more effectively for refining, as a result of which a smaller number of blade bars and blade grooves, or ones with a shorter total length are needed and, thus, the size of the refiner may be reduced. With the solution, a more continuous fiber flow than before is also achieved in the refiner chamber, as a result of which the effect of the refining surfaces is directed more to the fibers and less to the opposite refining surface, which in turn reduces the wear of the blades.

Figure 17:
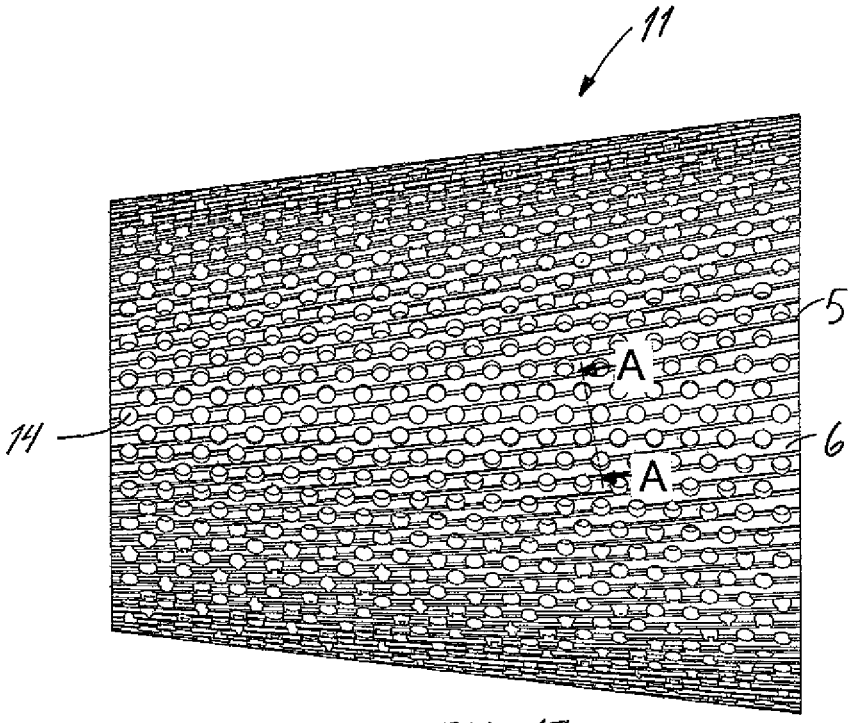
Figure 18:
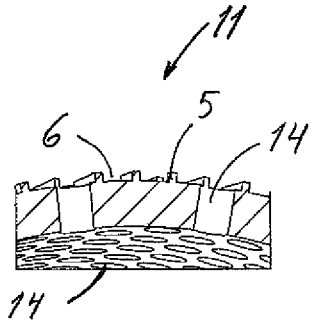
FIG. 18 schematically shows part of the refining surface of FIG. 17 in cross-section taken along section line A-A.

The solution also allows the flow of material to be defibrated to decrease in the direction of the plane or tangent of the refining surface, and the design of refining surfaces may thus be mainly focused on optimizing the refining effect directed at fibers, since the significance of the refining surface in the transport of material to be refined and of the already refined material is smaller. As a result, transfer of material on the refining surface may be arranged with fewer pressure losses than before and in more spacious feed and discharge channels of the refiner, thus reducing power losses in the refiner. The shape, size, and direction of the openings 14 and 15 formed on the refining surfaces as well as the ratio of their surface area to the total area of the refining surface may vary in many different ways. In the embodiment of FIG. 2, the openings 14 are elongated and directed substantially transverse to the direction of travel of the blade bars and blade grooves. However, the openings could also be round or oval or have different polygonal shapes, for example. In addition, their direction of travel may be entirely parallel to the blade bars 5 and blade grooves 6, perpendicular to the direction of travel of the blade bars and blade grooves, or in any angular direction between these two directions. The size or surface area of the openings may vary in many different ways. There may be a great deal of small openings or fewer large openings. The total area of the openings in comparison with the surface area of the refining surface may also vary in many different ways and ranges preferably from 5 to 70%, more preferably from 7 to 55%, and most preferably from 10 to 40%. All the above-mentioned properties of the openings may also differ from one another in a fixed refining surface and a moving refining surface. FIGS. 17 and 18 show a refining surface in which the openings 14 are round.

Figure 7:
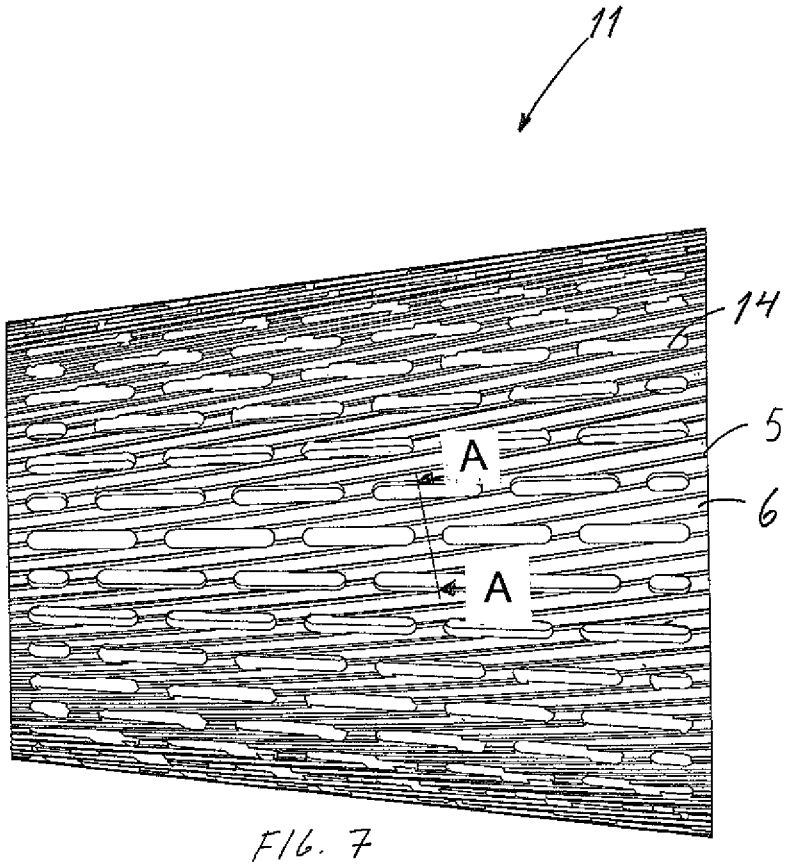
FIG. 7 schematically shows a side view of a second conical refining surface.
Figure 8:
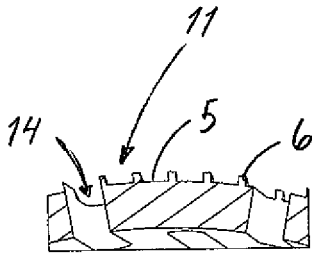
FIG. 8 schematically shows part of the refining surface of FIG. 7 in cross-section.
Figure 9:
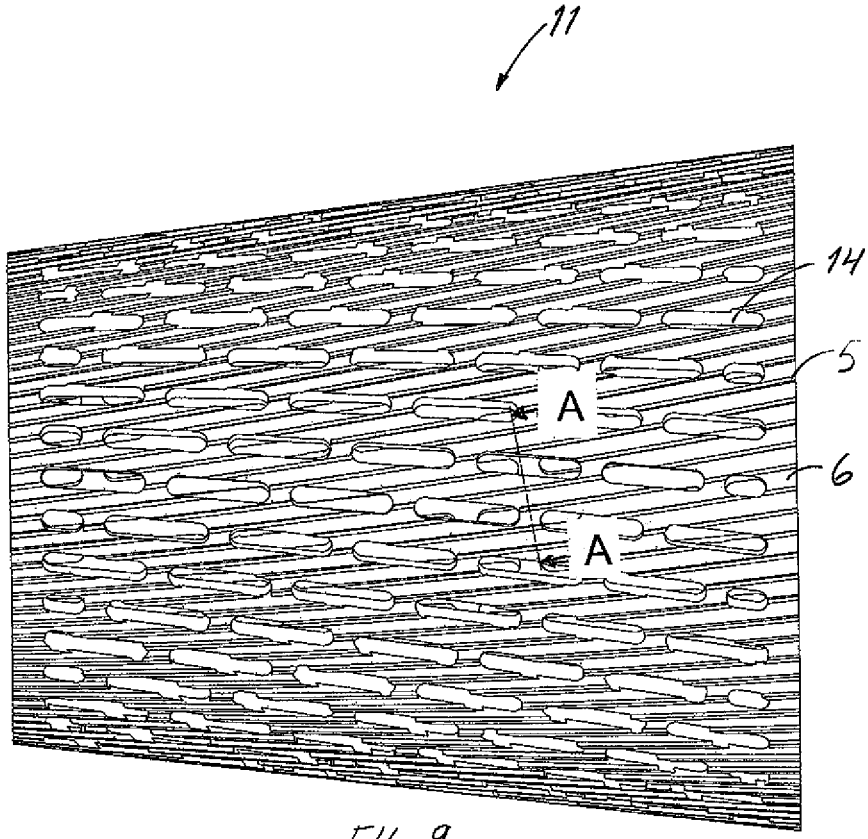
FIG. 9 schematically shows a side view of a third conical refining surface.
Figure 10:
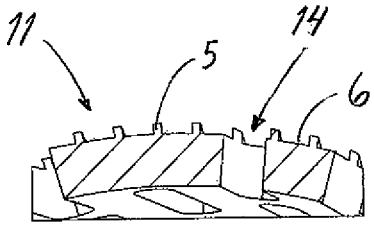
FIG. 10 schematically shows part of the refining surface of FIG. 9 in cross-section.
Figure 11:
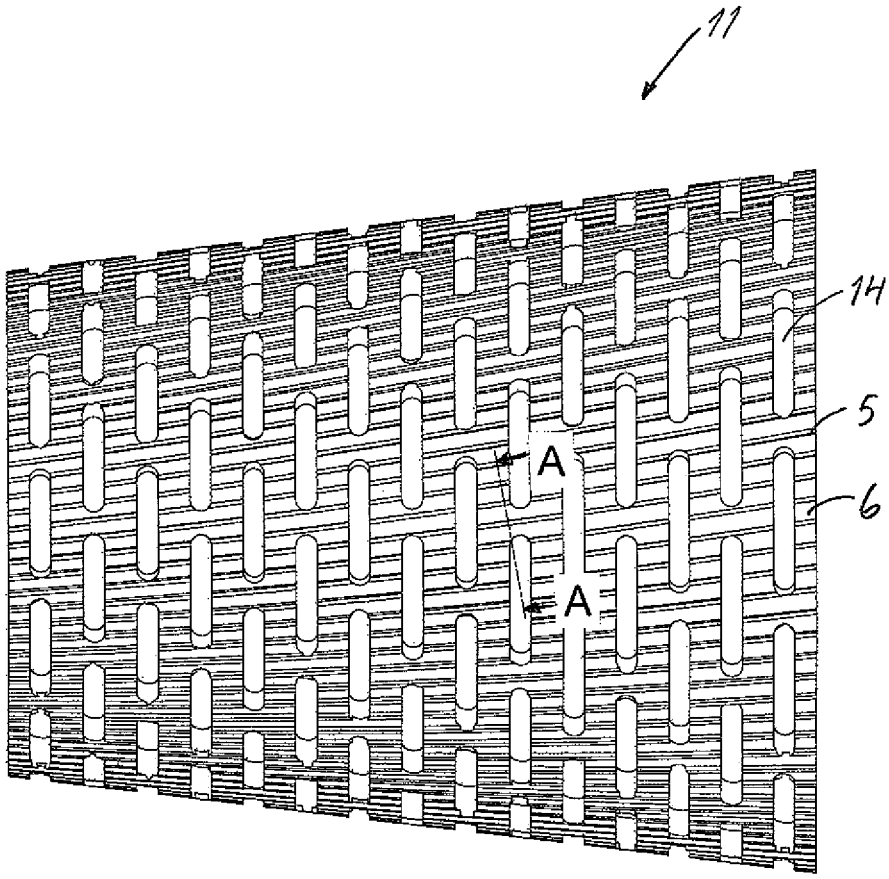
FIG. 11 schematically shows a side view of a fourth conical refining surface.
Figure 12:
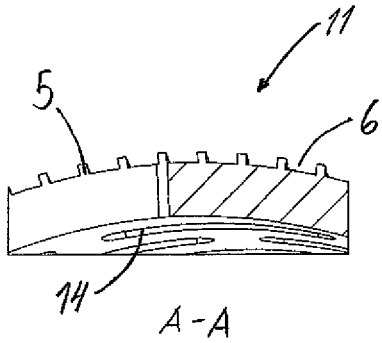
FIG. 12 schematically shows part of the refining surface of FIG. 11 in cross-section taken along section line A-A.

FIGS. 7 to 12 schematically show some conical refining surfaces with elongated openings 14. Elongated openings refer to openings that may be considered to have a specific longitudinal direction, i.e., a direction in which the distance between the edges of the opening is greater than the distance between the edges of the opening in the direction substantially transverse to this direction. In the embodiment of FIGS. 7 and 8, the elongated openings extend substantially parallel to the central axis or axis of the refining surface. In the embodiment of FIGS. 9 and 10 the elongated openings extend in a position oblique to the central axis of the refining surface, and in the embodiment of FIGS. 11 and 12 the elongated openings extend substantially transverse to the central axis of the refining surface. In FIGS. 7 to 12, the refining surfaces are depicted as refining surfaces of the refiner's rotor, but they might as well be refining surfaces of the refiner's stator.

The elongated openings 14 may thus be arranged substantially parallel to the central axis of the refining surface, as in FIGS. 7 and 8, but by forming elongated openings 14 and arranging the elongated openings on the refining surface at an oblique angle to the axis of the refiner blade, an optimal, large flow area of the openings is achieved so that the refining area contributing to the refining is large. Elongated openings take up only a little of the refining area or take up the refining area in a way that does not weaken the efficiency of the refiner. A refiner blade with elongated openings produces high-quality pulp with a high tensile strength and tear resistance. In addition, an even material flow is achieved throughout the refining area. The cross-sectional flow area of a straight flow channel extending through the stator and rotor, i.e., a channel that enables visual contact through the stator and rotor blade, is small in relation to the overall flow area of the openings, wherefore the material to be refined undergoes an efficient refining process and cannot significantly pass through the refiner without being refined. Also, the location of the straight flow channel extending through the stator and the rotor changes all the time when the refiner is being used, and thus the entire refining surface is utilized for refining. Elongated openings that are at an angle to the axis of the refiner and/or oblique to the normal direction of the refining surface may also produce a pumping effect or, alternatively, a retentive effect on the material being fed into the refiner and/or removed from the refiner, which effect speeds up or slows down the movement of the material in the desired direction as necessary. This way, it is also possible to maintain the fluidization of the material being refined. The angle of the elongated openings on the refining surface in the direction of the refiner axis, i.e., in the direction of the radius of the refining surface, is often preferably selected at 5 to 40 degrees, whereby the openings generally provide a suitable pumping or retentive effect from the feed edge of the refining surface toward the discharge edge of the refiner. When a higher pumping or retentive effect is needed, the angle between the direction of the openings and the refiner axis is selected from 40 to 60 degrees. The pumping or retentive effect may then be formed partly from placing the blade bars preferably at an intersecting angle to the direction of the openings, whereby the blade bars often cause to the material being processed an opposite effect than the openings, i.e., a pumping effect or a retentive effect depending on the direction of the blade bars and the rotational direction of the rotor. The pumping or retentive effect of directing the openings and blade bars of the rotor blade is greater than the effect of directing the stator blade openings due to the higher force effect generated by the rotor movement to the material being processed. The elongated openings of the feeding refining surface may be formed in such a manner that the length of an elongated opening comprises at least two blade bars and a groove between them, under the effect of which the pulp to be refined is distributed optimally in the refiner chamber, which results in a controlled, selected, and optimal dwell time in the refiner chamber and the subsequent discharge of the refined material from the blade gap through the openings on the opposite refining surface or the blade surface. This leads to a desired refining process.

The elongated openings may thus be placed at an angle crosswise to the blade bars and blade grooves of the refining surface. The angle between the elongated openings and blade bars and/or blade grooves of the refining surface may thus be 5 to 90 degrees, for example. Preferably the angle is 25 to 80 degrees and more preferably 50 to 70 degrees. When the elongated openings are at least partially parallel to the blade bars, which occurs for instance when the openings are at an angle of 5 to 80 degrees to the blade bars and thus not perpendicular to each other, a force component in the direction of the blade bars and blade grooves acts on the material being refined to enhance the travel of the material being refined in the grooves, but at the same time the direction of the opening forces the material being refined between the opposite refining surfaces, which in turn enhances the refining effect directed to the material being refined. With an angle of 50 to 70 degrees between the openings and blade bars and/or blade grooves, guiding force components are formed of the walls of the openings and blade bars to the material being processed in an especially suitable proportion in the direction of the blade grooves and between the blade bars, which means that in the refiner chamber a flow field is formed that provides a refining result of good quality and capacity.

When there are elongated openings on both the refining surface of the rotor and the refining surface of the stator, the openings may be mounted in the direction of the circumference of the refining surface, for instance, whereby a direct through-flow of the material being refined through the refining surfaces of the rotor and stator may be avoided and all material being refined is subjected to refining at least to some extent. The openings on the rotor refining surface and on the stator refining surface may be arranged on the refining surfaces in such a manner that, when the refining surfaces are opposite each other, the elongated openings may intersect each other, whereby it is possible that some of the material being refined passes through the refiner without being subjected to any refining effect, which in some cases may also be preferable depending on the required properties of the fibrous material. The free space formed between the intersecting elongated openings on the refining surfaces of the stator and rotor is at its minimum when the angle between the elongated opening on the stator refining surface and the blade bar is 45 degrees and the angle between the elongated opening on the rotor refining surface and the blade bar is also 45 degrees but in the opposite direction than in the rotor, whereby the elongated opening on the rotor refining surface and the elongate opening on the stator refining surface are perpendicular to each other. Thus, by altering the angle between the elongated openings and blade bars, it is possible to affect the size of the free area formed between the elongated opening on the stator refining surface and the elongate opening of the rotor refining surface.

Figure 13:
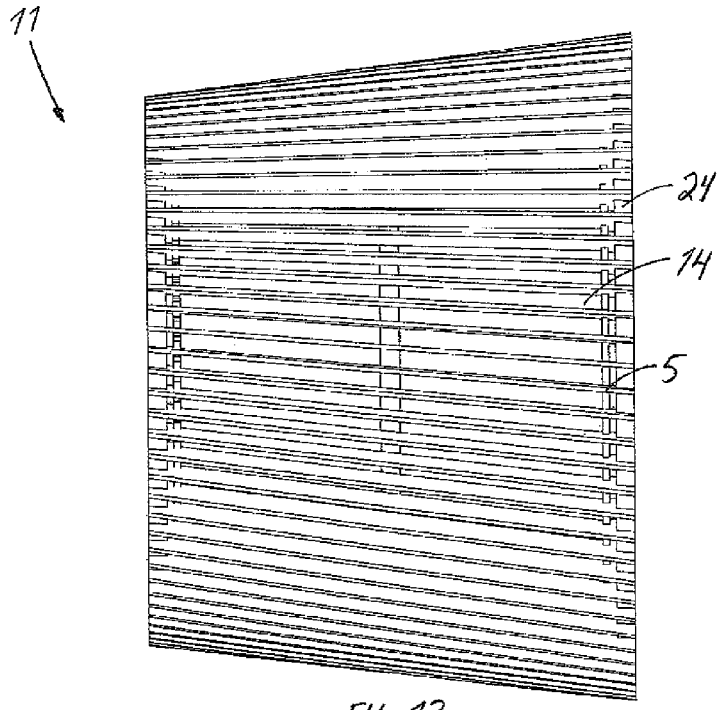
FIG. 13 schematically shows a side view of a fifth conical refining surface.
Figure 14:
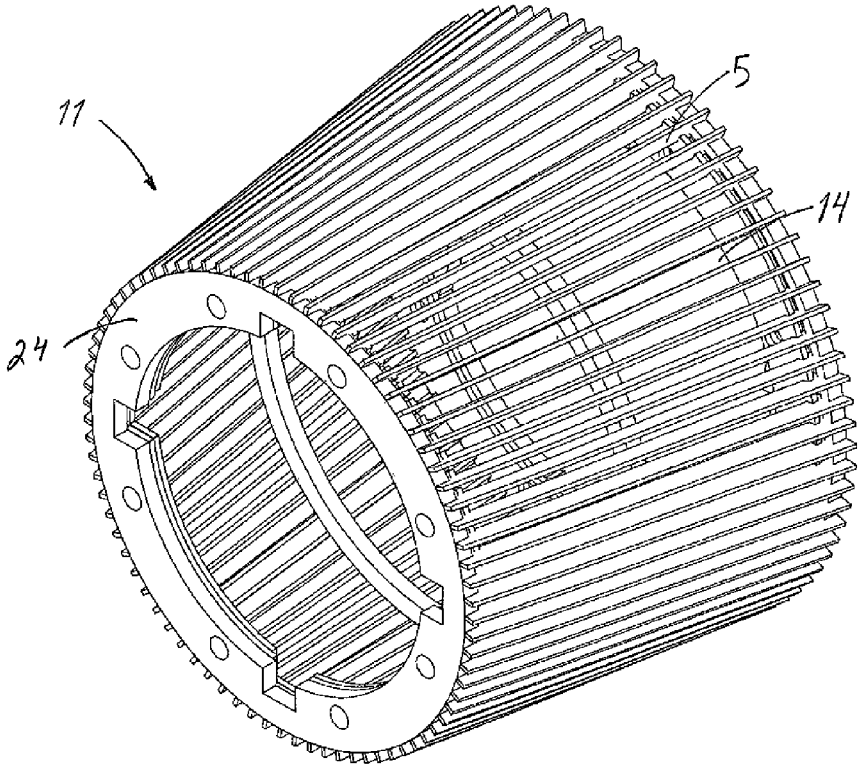
FIG. 14 schematically shows the refining surface of FIG. 13 axonometrically.

FIG. 13 schematically shows a side view of a conical refining surface, and FIG. 14 schematically shows the refining surface of FIG. 13 axonometrically. In FIGS. 13 and 14, the refining surface is depicted as a refining surface of the refiner's rotor but it might as well be a refining surface of the refiner's stator. In the embodiment of FIGS. 13 and 14, the refining surface 11 is in a position oblique to the central axis of the refiner and comprises rods or rims at a distance from one another in the circumferential direction of the refining surface, which form the blade bars 5 of the refining surface 11. The blade bars 5 are supported to support structures 24 or support rings 24 at the ends of the refining surface 11. Elongated openings 14 extending over the entire length of the blade bars 5 are formed between the blade bars 5. It may thus be considered that in the embodiment of FIGS. 13 and 14, the elongated openings 14 extend over the entire length of the grooves between the blade bars in such a manner that the bottom of the grooves is in its entirety covered by the elongated opening 14 extending through the refining surface 11. In this embodiment, the openings are densely located so the material being refined is efficiently guided directly to each blade bar for refining, whereby the refiner blades are efficiently utilized for refining.

In FIGS. 13 and 14, the cross-section of the rods, rims or wires forming the blade bars may be, for instance, rectangular as in the figure, square, triangular, or some other cross-sectional shape. Support rings strengthening the structure may be placed at the ends or in the middle region of the structure. The structure is attached to the refiner's frame preferably via the support rings at the ends, but may also be attached via the support rings in the middle of the structure, or by using both solutions. The wires are preferably placed at an angle of 0 to 30 degrees to the central axis. The wire width and the distances between the wires may be selected suitably on the basis of the fibrous material to be refined. The openings between the wires may extend in the direction of the radius or be inclined in either direction. In the extreme case, the openings, i.e., the flow channels, may extend over the entire length of the structure.

Figure 15:
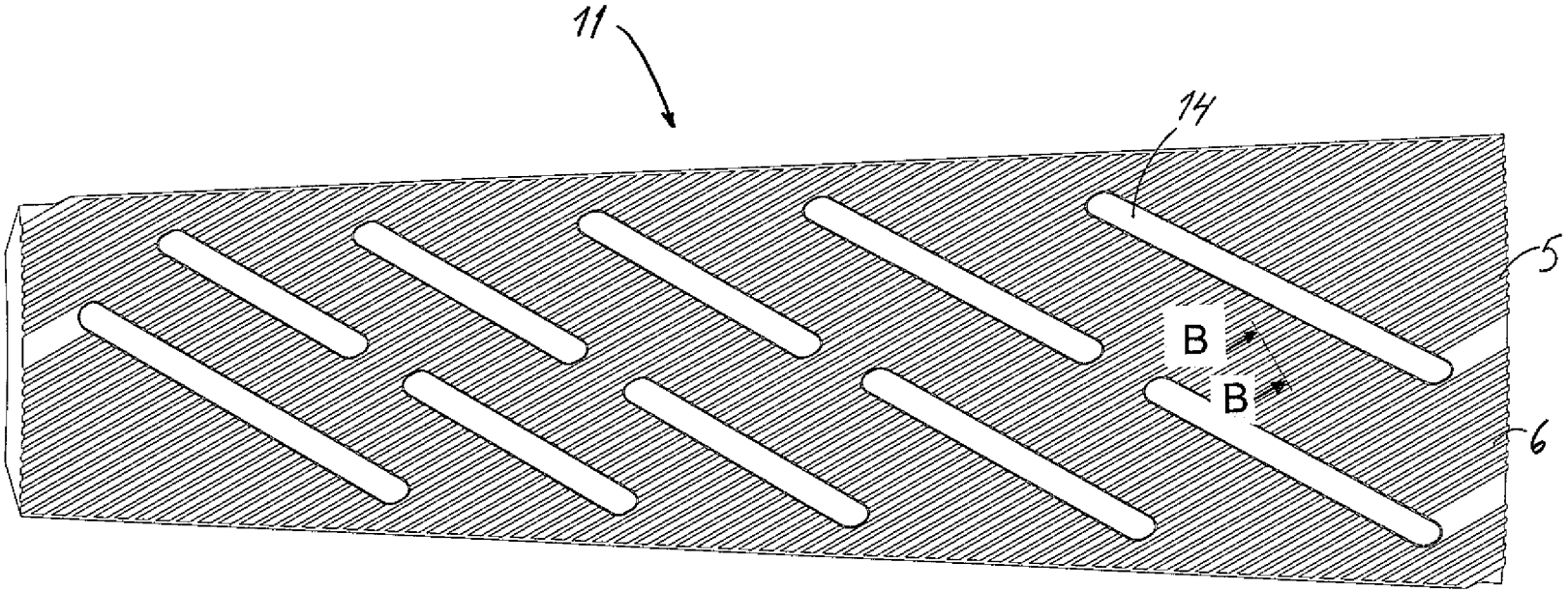
FIG. 15 schematically shows a side view of a blade segment suitable for a refining surface of a cone refiner from the side.
Figure 16:
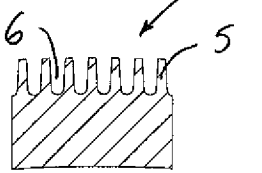
FIG. 16 schematically shows part of the refining surface of the blade segment of FIG. 15 in cross-section taken along section line B-B FIG. 17 schematically shows a side view of a sixth conical refining surface.

FIG. 15 schematically shows a side view of a blade segment suitable for a refining surface of a cone refiner, and FIG. 16 schematically shows in cross-section part of the refining surface of the blade segment according to FIG. 15. The blade segment shown in FIGS. 15 and 16 is suitable for constituting part of the refining surface of the rotor of a conical refiner. By arranging a suitable number of blade segments of FIG. 15 adjacent to one another, a uniform conical refining surface is achieved. In the embodiment of FIGS. 15 and 16, the openings formed through the refining surface are elongated but could also have another shape, such as a round or oval shape or various polygonal shapes, or they could be implemented in other previously explained ways. The refining surface of the refiner's stator may correspondingly be formed of blade segments. Refining surfaces made of blade segments may naturally also be used in cylindrical and cone refiners.

It is also possible to implement a refiner in which said openings formed through the refining surface for either feeding the material being refined into the refiner chamber or discharging the already refined material from the refiner chamber are formed only through either the moving refining surface or the fixed refining surface. In the embodiments of the figures, the openings are arranged on both the stator and rotor refining surfaces, but it is also possible to have the openings only on either the rotor or stator refining surface, in which case the feeding of the material to be refined into the refiner chamber may take place through said openings and the discharge of the already refined material may take place from the end of the refiner chamber, for instance, or vice versa.

It is also possible to implement a refiner in which the blade surface of the rotor has elongated openings that are at an angle to the blade bars and blade grooves of the blade surface (the embodiments of FIGS. 7 to 12 and 15 to 16 are examples of this), and the openings and blade bars on the blade surface of the stator are parallel (the blade surface of FIGS. 13 and 14 is an example of this). A refiner implemented contrary to this is also possible.

In some cases, the features described in this application may be used as such, regardless of other features. On the other hand, the features described in this application may also be combined as necessary to provide various combinations.

The drawings and the related description are only intended to illustrate the idea of the invention. The invention may vary in its details within the scope of the claims. In all embodiments shown in the figures, the refining surfaces of the refiners comprise blade bars and blade grooves between the bars for forming a refining surface, but it is naturally obvious that the refining surfaces of a refiner may also be provided in some other manner to achieve refining of fibrous material. It is also obvious that, if the refining surfaces comprise blade bars and blade grooves between the bars, the upper surface of the blade bars, i.e., the surface facing towards the opposite refining surface, may comprise smaller blade bars and blade grooves between the bars. It is also obvious that the blade bars and the blade grooves may be formed in a variety of ways in their longitudinal direction or direction of travel in such a manner, for instance, that the blade bars and the blade grooves between them are straight or curved.

The invention claimed is:

1. A refiner for refining fibrous material, the refiner comprising:

a source of fibers supplying a fiber inlet;

at least one first refining body having a first refining surface and at least one second refining body having a second refining surface, the first refining surface and the second refining surface arranged at least partly substantially opposite to one another to define a refining area, and a refiner chamber therebetween;

wherein the fiber inlet is in supplying relation to the refiner chamber, and a fiber outlet in receiving relation to the refiner chamber;

wherein the first refining body and the second refining body are arranged to provide movement between the first refining surface and the second refining surface;

wherein the first refining body comprises blade bars having portions most distant from the first refining body, said portions defining blade bar ends at the first refining surface where refining of fibrous material takes place and blade grooves which are between the blade bars and which have portions which extend to the blade bar ends;

wherein the second refining body comprises second blade bars having portions most distant from the second refining body, said portions defining blade bar ends at the second refining surface where refining of fibrous material takes place and second blade grooves which are between the second blade bars and which have portions which extend to the second blade bar ends;

wherein the first refining surface, and the second refining surface are defined as a surface which contains the blade bar ends and the blade groove portions extend to the blade bar ends of the first refining body or the second refining body respectively;

wherein the first refining body has portions defining a plurality of first elongated openings through the first refining body, each first elongated opening extending to the first refining surface through the first refining body and cutting through at least one first blade bar which crosses said elongated opening such that each first elongated opening crosses said at least one first blade bar to split said bar into two aligned but not continuous bar segments;

wherein the plurality of first elongated openings communicate directly between the refiner chamber and the fiber inlet or the fiber outlet;

wherein the first elongated openings through the first refining body are arranged at an angle transverse to the blade bars and blade grooves of the first refining body, the first elongated openings forming fibrous material supply openings, through which fibrous material to be refined can be fed into or discharged from the refiner chamber of the refiner.

2. The refiner of claim 1 wherein the second refining body has portions defining second elongated openings through the second refining body each second elongated opening extending to the second refining surface through the second refining body and cutting through at least one second blade bar which crosses said elongated opening such that each second elongated opening crosses said at least one second blade bar to split said blade bar into two aligned but not continuous bar segments;

wherein the plurality of second elongated openings communicate directly between the refiner chamber and the fiber outlet;

wherein the second elongated openings through the second refining body are arranged at an angle transverse to the second blade bars and second blade grooves of the second refining body, the second elongated openings forming fibrous material supply openings, through which fibrous material to be refined can be discharged from the refiner chamber of the refiner when fibrous material to be refined is fed into the second elongated openings directly to the fiber outlet.

3. The refiner of claim 1 wherein the first refining body is arranged to move so that the first refining surface of the refiner moves, and the second refining body is arranged fixed so that the second refining surface of the refiner is fixed.

4. The refiner of claim 1 wherein a surface area of the refining area between the first refining surface and the second refining surface is at least 70% of the surface area of the first refining surface.

5. The refiner of claim 4 wherein the surface area defined by the refining area between the first refining surface and the second refining surface is at least 85% of the first refining surface.

6. The refiner of claim 1 wherein a ratio formed between a surface area defined by the elongated openings in the first refining surface and the first refining surface is 5 to 70%.

7. The refiner of claim 6 wherein a ratio formed between a surface area defined by the elongated openings in the first refining surface and the first refining surface is 10 to 40%.

8. The refiner of claim 1 wherein the elongated openings in the first refining body are arranged at an angle of 25 to 80 degrees to the blade bars and blade grooves of the first refining surface.

9. The refiner of claim 8 wherein the elongated openings in the first refining body are arranged at an angle of 50 to 70 degrees to the blade bars and blade grooves of the first refining surface.

10. The refiner of claim 1 wherein the refiner type is selected from the group consisting of: a cone refiner, a cylindrical refiner, and a disc refiner.

11. A method for refining fibrous material comprising the steps of:

supplying fibrous material through a fiber inlet to a refiner in which at least one first refining body comprising first blade bars and first blade grooves between the first blade bars, and at least one second refining body comprising second blade bars and second blade grooves between the second blade bars, are arranged at least partly substantially opposite to one another to form a refiner chamber therebetween in which the fibrous material is refined, the refining chamber defining a refining area, wherein the fiber inlet is in supplying relation to the refiner chamber, and a refiner outlet is in receiving relation to the refiner chamber;

wherein the blade bars of each refining body have portions most distant from the first or second refining body respectively, defining blade bar ends where refining of fibrous material takes place, and wherein the blade grooves have portions which extend to the blade bar ends;

moving at least one of the first refining body and the second refining body relative to the other of the first refining body and the second refining body to refine fibrous material supplied to the refining chamber through the fiber inlet;

feeding the fibrous material into or discharging the fibrous material from the refiner chamber through first elongated openings defined by portions of the first refining body, each first elongated opening extending to a first refining surface;

wherein the first refining surface is defined as a surface which contains the blade bar ends of the first blade bars; the first elongated openings in the first refining body extending to the first refining surface through the first refining body and cutting through at least one first blade bar which crosses said first elongated opening such that each first elongated opening crosses said at least one first blade bar to split said first blade bar into two aligned but not continuous bar segments;

feeding fibrous material directly from the first elongated openings between the refiner chamber and the fiber inlet or the fiber outlet; and which first elongated openings are angled transverse to the blade bars and blade grooves of the first refining body.

12. The method of claim 11 further comprising the step of discharging fibrous material from the refiner chamber through second elongated openings defined by portions of the second refining body each elongated second opening extending from a second refining surface;

wherein the second refining surface is defined as a surface which contains the second refining body blade bar ends and the second refining body blade groove portions extend to the blade bar ends of the second refining body; the second elongated openings in the second refining body extending to the second refining surface through the second refining body and cutting through at least one second blade bar which crosses said second elongated opening such that each second elongated opening crosses said at least one second blade bar to split said second blade bar into two aligned but not continuous bar segments, so that fibrous material can flow through the second refining surface which second openings are arranged at an angle transverse to the second blade bars and second blade grooves of the second refining surface when discharging the fibrous material from the refiner chamber through the second elongated openings in the second refining body directly to the fiber outlet.

13. The method of claim 12 wherein the first refining body is fixed and the second refining body is moved.

14. The method of claim 12 wherein the first refining body is moved and the second refining body is fixed.

15. The method of claim 12 wherein the surface area of the refining area between the first refining surface and the second refining surface is at least 70% of the surface area of the first refining surface.

16. The method of claim 15 wherein the surface area of the refining area between the first refining surface and the second refining surface is at least 85% of the surface area of the first refining surface.

17. The method of claim 12 wherein the openings provided through the first refining body or the second refining body are arranged at an angle of 25 to 80 degrees to the blade bars and blade grooves of the first refining body or second refining body respectively.

18. The method of claim 17 wherein the openings provided through the first refining body or the second refining body are arranged at an angle of 50 to 70 degrees to the blade bars and blade grooves of the first refining body or second refining body respectively.

19. A blade segment for a refiner intended for refining fibrous material the refiner having a source of fibers supplying a fiber inlet, and a fiber outlet, wherein a plurality of abutting refiner blade segments is required to form a complete refiner surface; the blade segment comprising:

wherein the blade segment has a refining surface portion;

wherein the blade segment comprises blade bars having portions defining blade bar ends at the refining surface portion where refining of fibrous material takes place, and wherein blade grooves are defined between the blade bars and which blade grooves have portions which extend to the blade bar ends;

wherein the refining surface portion of the blade segment has portions defining elongated openings through the blade segment each elongated extending to the refining through the refining segment and cutting through at least one blade bar which crosses said elongated opening such that each elongated opening crosses said at least one blade bar to split said blade bar into two aligned but not continuous bar segments;

wherein the elongated openings communicate directly between the refining surface portion and the fiber inlet or the fiber outlet; and wherein the elongated openings through the blade segment are arranged at an angle transverse to the blade bars and blade grooves of the blade segment, the openings forming fibrous material supply openings, through which fibrous material to be refined can be fed into or discharged from the refining surface portion.

20. The blade segment of claim 19 wherein the openings provided through the refining surface portion of the blade segment are arranged at an angle of 50 to 70 degrees to the blade bars and blade grooves.

21. The refiner of claim 2 wherein each of the first elongated openings of the first refining body defines a first opening area;

wherein each of the elongated openings of the second refining body defines a second opening area;

a free area is defined as the area of openings formed between the first elongated openings of the first refining body and the second elongated openings of the second refining body; and wherein the first elongated openings of the first refining body cross the second elongated openings of the second refining body such that the free area through the first refining body and the second refining body is always small in relation to the first opening area and in relation to the second opening area.

22. The refiner of claim 1 wherein the first elongated openings of the first refining body each define an elongated opening length such that the elongated opening length cuts through at least two blade bars and a groove between them.

* * * * *

UNITED STATES PATENT AND TRADEMARK OFFICE

CERTIFICATE OF CORRECTION

PATENT NO. : 8,573,522 B2
APPLICATION NO. : 12/999666
DATED : November 5, 2013
INVENTOR(S) : Lindroos et al.

It is certified that error appears in the above-identified patent and that said Letters Patent is hereby corrected as shown below:

In the Claims:

Column 18, line 27, "blade segment each elongated extending to the refining" should be -- blade segment each elongated opening extending to the refining surface portion --.

Signed and Sealed this
Fourteenth Day of January, 2014

Michelle K. Lee

Michelle K. Lee
*Deputy Director of the United States Patent and Trademark Office*